US006383316B1

(12) United States Patent
Engström

(10) Patent No.: US 6,383,316 B1
(45) Date of Patent: May 7, 2002

(54) COLD DRAWN WIRE AND METHOD FOR THE MANUFACTURING OF SUCH WIRE

(75) Inventor: Claes-Henrik Engström, Örebro (SE)

(73) Assignee: Haldex Garphyttan Aktiebolag, Garphyttan (SE)

( * ) Notice: Subject to any disclaimer, the term of this patent is extended or adjusted under 35 U.S.C. 154(b) by 0 days.

(21) Appl. No.: 09/581,658

(22) PCT Filed: Dec. 8, 1998

(86) PCT No.: PCT/SE98/02238

§ 371 Date: Jun. 16, 2000

§ 102(e) Date: Jun. 16, 2000

(87) PCT Pub. No.: WO99/31282

PCT Pub. Date: Jun. 24, 1999

(30) Foreign Application Priority Data

Dec. 17, 1997 (SE) ..... 9704753

(51) Int. Cl.[7] ..... C22B 9/18; C21D 9/02; C21D 9/52

(52) U.S. Cl. ..... 148/542; 148/547; 148/580; 148/597; 148/599; 75/10.25

(58) Field of Search ..... 148/542, 547, 148/580, 597, 599; 75/10.24, 10.25; 420/56, 62

(56) References Cited

U.S. PATENT DOCUMENTS 3,917,492 A * 11/1975 Backman et al. ..... 148/12
4,027,720 A * 6/1977 Plockinger et al. ..... 164/52
4,265,679 A * 5/1981 Ohashi et al. ..... 148/12
4,589,916 A 5/1986 Sasayama

FOREIGN PATENT DOCUMENTS

EP 0 432 434 A1 6/1991 ..... C22C/38/38
JP 06-116685 A * 4/1994

OTHER PUBLICATIONS

"Metals Handbook: Desk Edition", 2nd ed., ASM International, (1998), pp 367–368.*

WPI/Derwent's Accession No. 85–308030, week 8549, Abstract of JP, 60215738, (Daido Tokushuko KK), Oct. 29, 1985; & Patent abstracts of Japan JP, A, 60215738, vol. 10, No. 78, Mar. 27, 1986.

* cited by examiner

*Primary Examiner*—George Wyszomierski
*Assistant Examiner*—Janelle Combs-Morillo
(74) *Attorney, Agent, or Firm*—Michael D. Bednarek; Shaw Pittman LLP

(57) ABSTRACT

Through electro slag refining of a bloom of a stainless, precipitation hardenable stainless steel of 17-7 PH type, the fatigue resistance of springs made of cold drawn wires of said material is increased substantially. This depends on the fact that large slag inclusions, which can initiate fatigue failures, are eliminated at the ESR remelting, while longer zones containing concentrations of small slag inclusions are substantially reduced. The material is particularly suitable for springs in injection pumps for Diesel engines.

10 Claims, No Drawings

COLD DRAWN WIRE AND METHOD FOR THE MANUFACTURING OF SUCH WIRE

TECHNICAL FIELD

The invention relates to a method for the manufacture of a cold drawn wire of a precipitation hardenable stainless steel. The invention also relates to the cold drawn wire and to precipitation hardened springs made of the cold drawn wire. Typically, the stainless steel in the springs consists of so called 17-7 PH steel.

BACKGROUND OF THE INVENTION

The precipitation stainless steel that contains appr 17% Cr, appr 7% Ni, and any precipitation hardening element, normally Al, was developed during the 1940'ies. It was disclosed in an article in the Iron Age, March 1950, pp 79–83. Already in this article, the suitability of the steel as a material for springs was suggested. Good spring features in combination with a good corrosion resistance have made the steel widely used as a spring material in corrosive environments. An environment of that type is injections pumps for Diesel engines, more particularly turbo Diesel engines. Springs which are used for this purpose must have a good corrosion resistance, which 17-7 PH steels have, in combination with a very high fatigue resistance of the springs. The latter condition, however, has been difficult to achieve. It has been known for long that the fatigue resistance to a high degree depends on the surface of the spring wire. In order that the spring shall have a high fatigue resistance, the wire must not have any visible defects, which can initiate fatigue failures. Nor shall the surface layer contain any large slag inclusions or large zones containing major accumulations of smaller slag inclusions, which also can initiate failures. These conditions, as far as the slag picture is concerned, have been difficult to satisfy and have caused significant rejection of wire that does not meet with the stipulated quality requirements. This in its turn has the effect that the wire material that has been approved in thorough quality control necessarily becomes very expensive. Nevertheless, one can not say that the material satisfies highest demands as far as fatigue resistance is concerned.

BRIEF DISCLOSURE OF THE INVENTION

It is a purpose of the invention to provide a solution of the above mentioned problems. The invention herein is based on the observation that large slag inclusions and zones of the above mentioned type in the surface layer of the rolled wire can be avoided or significantly reduced if the steel is electro slag refined, i.e. subjected to the treatment which is known under the short name ESR (=Electro Slag Refining, also referred to as Electro Slag Remelting). At the ESR treatment there can be used a conventional slag mixture which is used according to known technique, and which at the ESR remelting process forms a melt, in which the electrode that shall be remelted is molten off drop-wise, such that the drops will sink through the slag melt to an underlying pond of molten metal, which solidifies successively to form a new ingot. For example, a slag mixture can be used, which is known per se, and which contains appr 30% of each of $CaF_2$, CaO, and $Al_2O_3$ and normally a certain amount of MgO in lime fraction as well as one or a few percent $SiO_2$. In the case when the melting electrode, as according to the invention, consists of a stainless 17-7 PH steel, which contains slag inclusions of varying sizes, the remelted ingot will get a different slag picture than before the remelting operation. It appears that the ESR slag functions as a screen for larger slag particles existing in the steel prior to the remelting operation. At least this appears to be true for those slags which have proved to have a detrimental effect on the fatigue strength of the spring wire, namely slags of type CaO, $Al_2O_3$, and MgO. While the smaller slag inclusions become more evenly distributed and possible zones of slag accumulations become smaller and therefore more harmless, the amount of smaller slag inclusions of this type in the remelted material is influenced only to a low degree. The fatigue tests which have been performed with conventional materials and with materials according to the invention show that the critical slag size limit lies between 20 and 30 $\mu$m. Therefore, slag inclusions larger than 30 $\mu$m shall be avoided. Preferably, the wires should not contain slag particles larger than 25 $\mu$m.

The steel that is used according to the invention may have a chemical composition which is well known in the art and which as a matter of fact is standardized since long The method of the invention for the manufacture of a cold drawn wire of a precipitation hardenable stainless steel comprises the following steps:

- preparation of a melt, which besides iron contains in weight-%
  - 0.065–0.11% C.
  - from traces to max 1.2% Si
  - 0.2–1.3 Mn
  - 15.8–18.2% Cr
  - 6.0–7.9% Ni
  - 0.5–1.5% Al
  - totally max 2% of other, possibly existing alloying elements;
- casting the prepared melt to form ingots or, preferably, a strand, which is cut up into sections;
- electro slag refining said ingot or cut-up strand, possibly after forging and/or rolling to the shape of electrodes suitable for electro slag refining, to form ESR ingots;
- hot working said ESR ingots, said hot working being finished by wire rolling, followed by pickling for the formation of a pickled, rolled wire,which in a surface layer thereof, to the depth of 1 mm counted from the surface, in a longitudinal, central section through the wire, does not contain slag inclusions larger than 30 $\mu$m, preferably max 25 $\mu$m; and
- cold drawing the wire with at least 30% reduction.

Al is added as a subsequent operation, when the molten metal has got its intended basic composition through conventional steel manufacturing practice, suitably in a ladle treatment process which follows subsequent to decarburisation in a converter.

During the ESR remelting operation, a certain amount of that aluminium, which was added in connection with the initial preparation of the molten metal, can be lost. Therefore, in connection with the ESR remelting operation, more aluminium ought to be supplied to the melting pond for the replacement of any losses, so that the ESR ingot obtained after the ESR remelting operation will contain 0.5–1.5 Al.

More specifically the invention relates to the manufacture of a precipitation hardenable stainless steel according to the method that is described in the foregoing, which steel besides iron contains in weight-%:

- 0.3–0.1, preferably max. 0.09 C.
- 0.1–0.8, preferably 0.2–07 Si
- 0.5–1.1, preferably 0.7–1.0 Mn
- max. 0.05, preferably max 0.03 P
- max 0.04, preferably max 0.02 S 16.0–17.4, preferably 16.5–17.0 Cr 6.8–7.8, preferably 7.0–7.75 Ni 0.6–1.3, preferably 0.75–1.0 Al max 0.5 Mo max 0.5 Co max 0.5 Cu max 0.1, preferably max 0.05 N max 0.2, preferably max 0.01 Ti Helicoidal springs are spun in a conventional mode of the cold drawn wire according to the invention. The springs are precipitation hardened through heat treatment at a temperature of 450–500° C. for 0.5–2 h, suitably at appr 480° C. for 1 h. followed by cooling in air. The structure of the material in the finished springs consists of 50–70 volume-% tempered martensite containing precipitated phases of aluminium and nickel in the martensite, preferably $AlNi_3$, remainder austenite and max 5% δ-ferrite.

EMBODIMENTS AND PERFORMED EXPERIMENTS

Through conventional melting metallurgical practice, comprising melting raw materials in an electrical arc furnace, decarburisation of the melt in a converter, desoxidation treatment, and final adjustment of the alloy composition in a ladle, said adjustment comprising addition of aluminium and titanium, there was obtained a bulk of molten metal (heat No. 370326) having the following composition in weight-%:

| C | Si | Mn | P | S | Cr | Ni | Mo | Co | Cu | N | Al | Ti | Bal. |
|---|---|---|---|---|---|---|---|---|---|---|---|---|---|
| 0.078 | .25 | .83 | .022 | .001 | 16.47 | 7.72 | .27 | .14 | .25 | .018 | 1.00 | .052 | Fe |

This melt was cast to the form of a strand having the cross section 300×400 mm. The strand was cut up to blooms. A number of these blooms were rolled to the size 265–300 mm and were used as electrodes for subsequent ESR remelting. The remaining blooms were hot rolled to form rods with 150 mm square section, which rods were surface ground, hot rolled to the shape of wire with the Ø5.5 mm, and pickled.

The ESR melting was carried out in a conventional way in a slag melt consisting of appr 30% of each of $CaF_2$, CaO, and $Al_2O_3$. Also a certain amount of MgO was present in the lime fraction. The slag also contained a minor amount of $SiO_2$. Through remelting of the electrodes in this slag, there was formed an ESR ingot (ESR-heat 14484) with the following composition in weight-%

| C | Si | Mn | P | S | Cr | Ni | Mo | Co | Cu | N | Al | Ti | Bal. |
|---|---|---|---|---|---|---|---|---|---|---|---|---|---|
| 0.080 | .27 | .81 | .025 | .0001 | 16.40 | 7.68 | .27 | .13 | .26 | .015 | .91 | .050 | Fe |

During the ESR remelting, the composition of the steel was influenced to a certain degree. This particularly concerned the content of aluminium, which was reduced significantly, which indicates that aluminium ought to be added in connection with the ESR remelting in order to compensate for the losses. This can be carried out by means of an aluminium wire, which is caused to melt off in the melting pond beneath the slag layer.

Rods with 150 mm square section were manufactured through hot working from the ESR ingot. The rods were ground and hot rolled to wires with the size Ø5.5 mm. The rolled wires were pickled and samples were taken out for slag examination.

For the slag examination, 500 mm long sections were taken from the rolled wire which had been made from the material that was not ESR remelted and also from the ESR remelted material. The samples were cut to smaller, 20 mm long pieces, which were arranged in bodies of cast and cured plastic. In these bodies, the sample pieces were ground down to half their thickness, so that cut surfaces in the longitudinal direction of the samples pieces were obtained, the cut surfaces coinciding with a center plane of the sample pieces. The longitudinal edge zones were examined to a depth of 1 mm from the original surface of the wire by means of a light-optical microscope. All the sample pieces were examined in this way. The total surface, which was examined for each sample length, the total length of which was 500 mm, thus was 1000 $mm^2$. Oxidic slag inclusions (particles) which could be discovered in the light-optical microscope were notified as well as the existance of any brands or zones containing larger accumulations of slag inclusions. The slag inclusions were classified in three size groups, A, B, and C, for small slag inclusions (5–10 μm), medium size slag inclusions (>10–15 μm), and large slag inclusions (>15 μm). Further, the number of zones of slag inclusions were notified, the length of such zones, and the type of size of the slag inclusions in these zones. The results are given in Table 1, where materials $1a_w$ and $1b_w$ are rolled wire material manufactured in the conventional manner starting from the above mentioned heat No. 370326 without ESR remelting, and the rolled wire material, which according to the invention has been ESR remelted, heat 14484-ESR. None of the materials $1a_w$ or $1b_w$ contained any large slag inclusions in the surface layer. However, material $1a_w$ contained as much as 17 slag zones having lengths varying between 25 and 450 μm. These zones contained small and medium size slag inclusions. The material $1b_w$ which was manufactured according to the invention, contained only one observable slag zone, which had a length of 63 μm and which contained only small slag inclusions. This material may, from a slag inclusion point of view, be considered as acceptable.

More material then was produced with the same basic composition as before. The manufacture and the slag examinations were performed in the same way as described above. The results achieved with these test materials are also shown in Table 1, in which materials $2a_w$, and $3a_w$ consist of rolled wires made of materials that have not been ESR remelted, while materials $2b_w$ and $3b_w$ were subjected to ESR remelting according to the invention. The $2a_w$ and $3a_w$ materials contained large slag particles and also slag bands or zones of considerable length containing accumulations of slag inclusions, material $3a_w$ containing slag zones with small as well as medium size slag inclusions. Therefore, also the materials $2a_w$, and $3a_w$ were non approvable as materials for springs for injections pumps for Diesel engines as distinguished from the materials $2b_w$ and $3b_w$, which did not contain any large slag inclusions in the surface layers and no or only some minor zone containing small accumulations of small slag inclusions.

All the slag inclusions that have been discussed above consisted of CaO, $Al_2O_3$, and MgO. Also Ti-nitrides were observed but were not entered in the slag protocols. These Ti-nitrides eminate from a practice during the steel manufacturing process, in which titanium is added in order to prevent the formation of large, oxidic inclusions. The small Ti-nitrides, which are formed because of this practice, have been regarded as harmless. However, they have pronouncedly angular shape and it is therefore a potential risk that they can initiate fatigue failures. Therefore, titanium should not be added to the melt, especially as the large slag inclusions have proved to be effectively eliminated by the ESR refining. Preferably, therefore, one should prepare a bulk of molten metal which does not contain titanium in amounts exceeding impurity level.

TABLE 1

| Slag picture in the surface layer | | | | |
|---|---|---|---|---|
| Material Hot | Number of slag particles/1000 mm$^2$ | | | Slag zones/500 mm wire |
| rolled wire | A 5–10 μm | B >10–15 μm | C >15 μm | Number of/length of (μm)/type of size |
| $1a_w$ | 50 | 1 | 0 | 17/25-450/A + B |
| $1b_w$ | 50 | 2 | 0 | 1/63/A |
| $2a_w$ | 35 | 4 | 1 | 2/165-330/A |
| $2b_w$ | 25 | 3 | 0 | 0 |
| $3a_w$ | 33 | 4 | 1 | 2/max 330/A + B |
| $3b_w$ | 49 | 2 | 0 | 1/63/A |

Those rolled wires, out of which samples were made, which were analysed with reference to the slag picture in the surface layers, then were cold drawn to sizes ~3.3 mm Ø. Through deformation hardering, the substantially austenitic structure of the rolled wire was transformed to a mixed structure consisting of 50–70% martensite, the remainder mainly being austenite with some minor portion of δ-ferrite. Springs with conventional helicoidal shape were spun of the cold drawn material. The springs then were precipitation hardened through treatment at 480° C. for 1 h followed by cooling in air. During the heating operation, intermetallic phases of aluminium and nickel were precipitated, typically $AlNi_3$, in the martensite in a way which is typical for 17-7 PH steels, causing the tensile strength to increase by 380–400 MPa.

The hardened springs then were subjected to fatigue testing. This was carried out by tightening the springs with an under-tension of 100 MPa and then compressing them with a tension of 900 MPa. This compression and release were repeated at a high frequency 20 million times for each spring or until rupture occured. Twenty springs made of each of the materials were tested. The results are given in Table 2, in which the springs $1a_s$, $2a_s$, and $3a_s$ are made of wires manufactured conventionally, while the springs $1b_s$, $2b_s$, and $3b_s$ are made of cold drawn wires manufactured according to the invention. The table shows that the springs of the invention not in any single case were fatigued to fracture, while 20%, 90%, and 75%, respectively of the reference springs were fatigued to fracture before 20 millions of oscillations had been performed.

TABLE 2

| Fatigue testing | |
|---|---|
| Materials; Springs made of cold drawn precipitation hardened wire | 20 springs fatigue tested; % springs brought to failure before 20 million of compression/return movements |
| $1a_s$ | 20 |
| $1b_s$ | 0 |
| $2a_s$ | 90 |
| $2b_s$ | 0 |
| $3a_s$ | 75 |
| $3b_s$ | 0 |

It should be realised that the invention can be varied within the scope of the appending claims. The experiments which have been referenced in the foregoing concern manufacture of cold drawn spring wires having circular cross section. The invention, however, is not bound only to wires having such cross section, but can be applied also for wires having other shapes, i.e. wires having oval cross section, which can afford a more favourable distribution of tension in the finished springs which are spun to helicoidal shape.

What is claimed is:

1. A method of manufacturing a cold drawn wire of a precipitation hardenable stainless steel, comprising the steps of:

preparing a bulk of molten metal, which besides iron contains in weight %:
0.065–0.11 % C;
traces-1.2% Si;
0.2–1.3% Mn;
15.8–18.2% Cr;
6.0–7.9% Ni;
0.5–1.5% Al; and
a total maximum 2% of other alloying elements;

casting the prepared molten metal into the shape of one of an ingot and a strand, wherein said strand is subsequently cut up;

hot working said one of said ingot and cut up strand to the shape of electrodes for electro slag refining (ESR);

subjecting the electrodes to ESR to form ESR refined ingots;

hot working the resulting ESR refined ingots and finishing by wire rolling;

pickling the resulting rolled wire; and cold drawing the resulting pickled rolled wire with at least a 30% reduction in area, wherein a surface layer of the resulting pickled rolled wire, the surface layer being defined as a region between a surface of the resulting pickled rolled wire and a depth of 1 mm from that surface in a longitudinal central section through the resulting pickled rolled wire, does not contain slag inclusions larger than 30 μm.

2. The method of claim 1, wherein the surface layer does not contain slag inclusions larger than 20 μm.

3. The method of claim 1, further comprising supplying aluminum to a pond of molten metal to replace aluminum during ESR remelting so that the resulting ESR refined ingots obtained after the ESR step contain 0.5–1.5% Al.

4. The method of claim 1, wherein the Al content is maintained to be 0.5–1.5% by adding aluminum during the ESR remelting operation to replace any losses during the ESR remelting operation of that aluminum which was added in connection with the initial preparation of the molten metal.

5. The method of claim 1, wherein the precipitation hardenable stainless steel, besides iron, comprises in weight %:

0.03–0.1 C;

0.1–0.8 Si;

0.5–1.1 Mn;

0.5–1.1 Mn;

no more than 0.05 P;

no more than 0.04 S 16.0–17.4 Cr;

6.8–7.8 Ni;

0.3–1.3 Al;

no more than 0.5 Mo;

no more than 0.5 Co;

no more than 0.5 Cu;

no more than 0.1 N; and no more than 0.2 Ti.

6. The method of claim 1, wherein the precipitation hardenable stainless steel, besides iron, comprises in weight%:

0.075–0.09 C;

0.2–0.7 Si;

0.7–1.0 Mn;

no more than 0.03 P;

no more than 0.02 S 16.5–17.0 Cr;

7.0–7.75 Ni;

0.75–1.0 Al;

no more than 0.5 Mo;

no more than 0.5 Co;

no more than 0.5 Cu;

no more than 0.50 N; and no more than 0.01 Ti.

7. The method of claim 1, wherein slag that is used for the ESR step comprises a melt mixture of slags which predominantly consist of two or more of $CaF_2$, CaO, $Al_2O_3$, and MgO.

8. The method of claim 7, wherein the slag contains about 30% each of $CaF_2$, CaO, $Al_2O_3$, and a smaller percentage of MgO.

9. The method of claimed 1, wherein the pickled rolled wire is cold drawn so that through deformation hardening, a substantially austenitic structure of the wire is transformed to a mixed structure consisting essentially of martensite and austenite.

10. The method of claim 1, wherein the substantially austenitic structure of the wire is transformed to a mixed structure consisting of 50–70% martensite, the remainder mainly being austenite.

* * * * *